US009343011B2

(12) United States Patent
Yang et al.

(10) Patent No.: US 9,343,011 B2
(45) Date of Patent: May 17, 2016

(54) PIXEL FOR CONTROLLING CURRENT FLOWING FROM POWER SUPPLY AND ORGANIC LIGHT EMITTING DISPLAY USING THE SAME

(71) Applicant: Samsung Display Co., Ltd., Yongin, Gyeonggi-do (KR)

(72) Inventors: Jin-Wook Yang, Yongin (KR); Bon-Seog Gu, Yongin (KR); Woo-Seok Han, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 465 days.

(21) Appl. No.: 13/706,155

(22) Filed: Dec. 5, 2012

(65) Prior Publication Data

US 2014/0062843 A1 Mar. 6, 2014

(30) Foreign Application Priority Data

Aug. 30, 2012 (KR) ..... 10-2012-0095477

(51) Int. Cl.
*G09G 3/30* (2006.01)
*G09G 3/32* (2016.01)

(52) U.S. Cl.
CPC ..... *G09G 3/3233* (2013.01); *G09G 2300/0809* (2013.01); *G09G 2300/0861* (2013.01); *G09G 2320/0295* (2013.01); *G09G 2320/045* (2013.01)

(58) Field of Classification Search
CPC ..... G09G 3/3233; G09G 2300/0439; G09G 2300/0809; G09G 2320/045; G09G 2320/0295
USPC ..... 345/76
See application file for complete search history.

(56) References Cited

U.S. PATENT DOCUMENTS

2004/0150590 A1 8/2004 Cok et al.
2006/0244695 A1* 11/2006 Komiya ..... G09G 3/006 345/76
2008/0186301 A1* 8/2008 Park ..... G09G 3/3233 345/211
2008/0252568 A1* 10/2008 Kwon ..... 345/76
2009/0225013 A1* 9/2009 Lee et al. ..... 345/80
2011/0109598 A1* 5/2011 Oh ..... G09G 3/3233 345/204
2011/0227505 A1 9/2011 Park et al.
2011/0227889 A1* 9/2011 Choi ..... 345/209
2012/0062536 A1* 3/2012 Park ..... 345/211
2012/0105495 A1 5/2012 Choi

FOREIGN PATENT DOCUMENTS

KR 10-2011-0104705 A 9/2011
KR 10-2012-0044503 A 5/2012

* cited by examiner

*Primary Examiner* — Jonathan Blancha
(74) *Attorney, Agent, or Firm* — Knobbe Martens Olson & Bear LLP

(57) ABSTRACT

A pixel capable of displaying an image with uniform brightness is disclosed. In one aspect, the pixel includes an organic light emitting diode (OLED), a first transistor for controlling an amount of current that flows from a first power supply to a second power supply via the OLED in response to a voltage applied to a first node. The pixel also includes a second transistor that is coupled between a bias power supply and the first node and whose gate electrode is coupled to an emission control line. The pixel further includes a third transistor that is coupled between an anode electrode of the OLED and a feedback line and whose gate electrode is coupled to a control line.

25 Claims, 7 Drawing Sheets

PIXEL FOR CONTROLLING CURRENT FLOWING FROM POWER SUPPLY AND ORGANIC LIGHT EMITTING DISPLAY USING THE SAME

CROSS-REFERENCE TO RELATED APPLICATION

This application claims priority to and the benefit of Korean Patent Application No. 10-2012-0095477, filed on Aug. 30, 2012, in the Korean Intellectual Property Office, the entire content of which is incorporated herein by reference.

BACKGROUND

1. Field

The described technology generally relates to a pixel and an organic light emitting display using the same.

2. Description of the Related Technology

Recently, various flat panel displays (FPD) have been developed. The FPDs include liquid crystal displays (LCD), field emission displays (FED), plasma display panels (PDP), and organic light emitting diode (OLED) displays.

OLED displays display images using OLED that generate light by re-combination of electrons and holes. The OLED display has high response speed and is driven with low power consumption.

The OLED display includes a plurality of pixels arranged at intersections of a plurality of data lines, scan lines, and power supply lines in a matrix. Each of the pixels commonly includes an OLED and a driving transistor for controlling the amount of current that flows to the OLED. The pixels generate light components with predetermined brightness components while supplying currents from the driving transistors to the OLEDs to correspond to data signals.

SUMMARY

One inventive aspect is a pixel capable of displaying an image with uniform brightness and an organic light emitting display using the same.

Another aspect is a pixel, including an organic light emitting diode (OLED), a first transistor for controlling an amount of current that flows from a first node to a second power supply via the OLED to correspond to a voltage applied to a first node, a second transistor that is coupled between a bias power supply and the first node and whose gate electrode is coupled to an emission control line, and a third transistor that is coupled between an anode electrode of the OLED and a feedback line and whose gate electrode is coupled to a control line.

The voltage value of the bias power supply is set so that an off bias voltage is applied to the first transistor. The voltage of the bias power supply is set to be higher than the first power supply. The pixel further includes a fourth transistor that is coupled between the first node and a data line and whose gate electrode is coupled to a scan line and a storage capacitor whose first terminal is coupled to the first node and whose second terminal is coupled to the first power supply. The second transistor may be turned on prior to the fourth transistor. The second transistor may be turned on after the fourth transistor is turned off. The turn on period of the second transistor may overlap with the turn on period of the fourth transistor. When the turn on period of the second transistor overlaps the turn on period of the fourth transistor, the bias power supply is set in a high impedance state. The third transistor is turned on in a partial period of a period in which the second transistor is turned on in a specific frame period of a plurality of frames.

The pixel further includes a fifth transistor that is coupled between a reference power supply and a second terminal of the storage capacitor and whose gate electrode is coupled to the emission control line, a sixth transistor that is coupled between the first power supply and the second terminal of the storage capacitor and whose gate electrode is coupled to an inverted emission control line, and a seventh transistor that is coupled between the first power supply and the first transistor and whose gate electrode is coupled to the inverted emission control line.

The sixth transistor and the second transistor are alternately turned on and off. The second transistor is turned on prior to the fourth transistor. The fourth transistor is turned on so that the turn on period of the fourth transistor overlaps the turn on period of the second transistor. When the turn on period of the second transistor overlaps the turn on period of the fourth transistor, the bias power supply is set in a high impedance state. The third transistor is turned on in a partial period of a period in which the second transistor is turned on in a specific frame period of a plurality of frames.

Another aspect is an organic light emitting display, including a scan driver for driving scan lines and emission control lines, a data driver for driving data lines, a control line driver for driving control lines, a sensing unit coupled to feedback lines, and pixels positioned at intersections of the scan lines and the data lines. Each of pixels positioned in an ith (i is a natural number) horizontal line includes an organic light emitting diode (OLED), a first transistor for controlling an amount of current that flows from a first node to a second power supply via the OLED to correspond to a voltage applied to a first node, a second transistor coupled between a bias power supply and the first node, turned on when an emission control signal is supplied to an ith emission control line, and turned on in the other cases, and a third transistor coupled between an anode electrode of the OLED and a jth (j is a natural number) feedback line and turned on when a control signal is supplied to an ith control line.

The voltage value of the bias power supply is set so that an off bias voltage is applied to the first transistor. The voltage of the bias power supply is higher than a voltage of the first power supply. Each of the pixels positioned in the ith horizontal line further includes a fourth transistor coupled between the first node and a jth data line and turned on when a scan signal is supplied to an ith scan line and a storage capacitor whose first terminal is coupled to the first node and whose second terminal is coupled to the first power supply.

Supply of an emission control signal to the ith emission control line is stopped before a scan signal is supplied to the ith scan line. The emission control signal supplied to the ith emission control line overlaps the scan signal supplied to the ith scan line. The emission control signal supplied to the ith emission control line does not overlap the scan signal supplied to the ith scan line. The bias power supply is set in a high impedance state when the scan signal is supplied to the ith scan line. A control signal is supplied to the ith control line not to overlap the emission control signal supplied to the ith emission control line in a specific frame period of a plurality of frames.

The organic light emitting display further includes inverted emission control lines driven by the scan driver and formed to be coupled to the pixels in every horizontal line. An inverted emission control signal is supplied to an ith inverted emission control line in the same period as the emission control signal and has polarity inverted. Each of the pixels positioned in the ith horizontal line further includes a fifth transistor coupled between a reference power supply and a second terminal of the storage capacitor, turned off when the emission control signal is supplied to the ith emission control line, a sixth transistor coupled between the first power supply and a second terminal of the storage capacitor, turned on when the inverted emission control signal is supplied to the ith inverted emission control line, and turned off in the other cases, and a seventh transistor coupled between the first power supply and the first transistor, turned on when the inverted emission control signal is supplied to the ith inverted emission control line, and turned off in the other cases.

DETAILED DESCRIPTION

Figure 1:
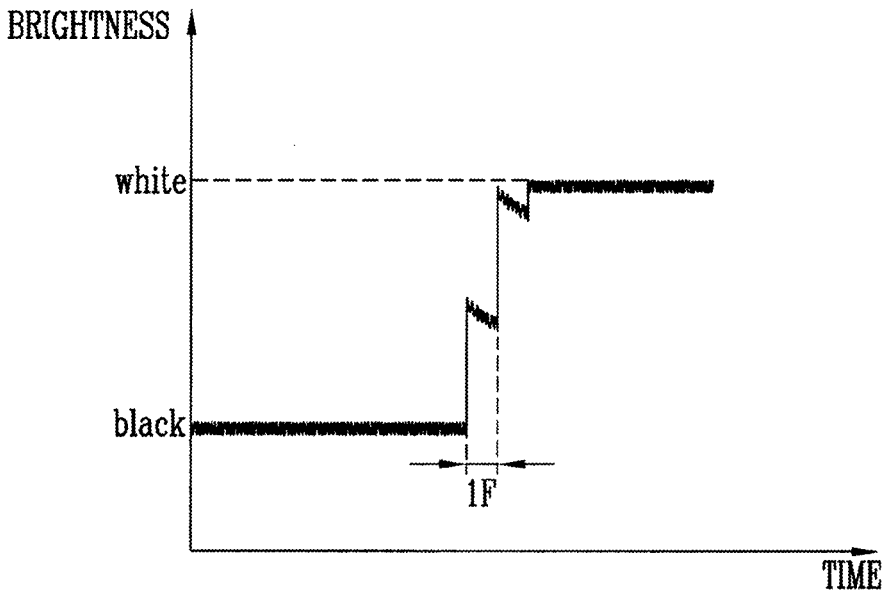
FIG. 1 is a view illustrating a deviation in brightness components corresponding to gray scales.

Generally, when a white gray scale is displayed after realizing a black gray scale as illustrated in FIG. 1, light with lower brightness than desired brightness is generated in a period of about two frames. In this case, an image with desired brightness is not displayed by the pixels to correspond to gray scales so that uniformity in brightness deteriorates and that picture quality of a moving picture deteriorates.

As a result of experiment, deterioration of the response characteristic of the organic light emitting display is caused by the characteristic of the driving transistors included in the pixels. That is, the threshold voltages of the driving transistors are shifted to correspond to voltages applied to the driving transistors in a previous frame period. Due to the shifted threshold voltages, light components with desired brightness components are not generated in a current frame.

In addition, organic light emitting diodes (OLED) deteriorate in proportion to the amount of use. When the OLEDs deteriorate due to a change in efficiency, an image with desired brightness is not displayed. This results in reduced brightness for the same data signal.

Hereinafter, embodiments will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the present disclosure are omitted for clarity. Also, like reference numerals refer to like elements throughout.

Hereinafter, a pixel and an organic light emitting display using the same will be described in detail as follows with reference to FIGS. 2 to 8.

Figure 2:
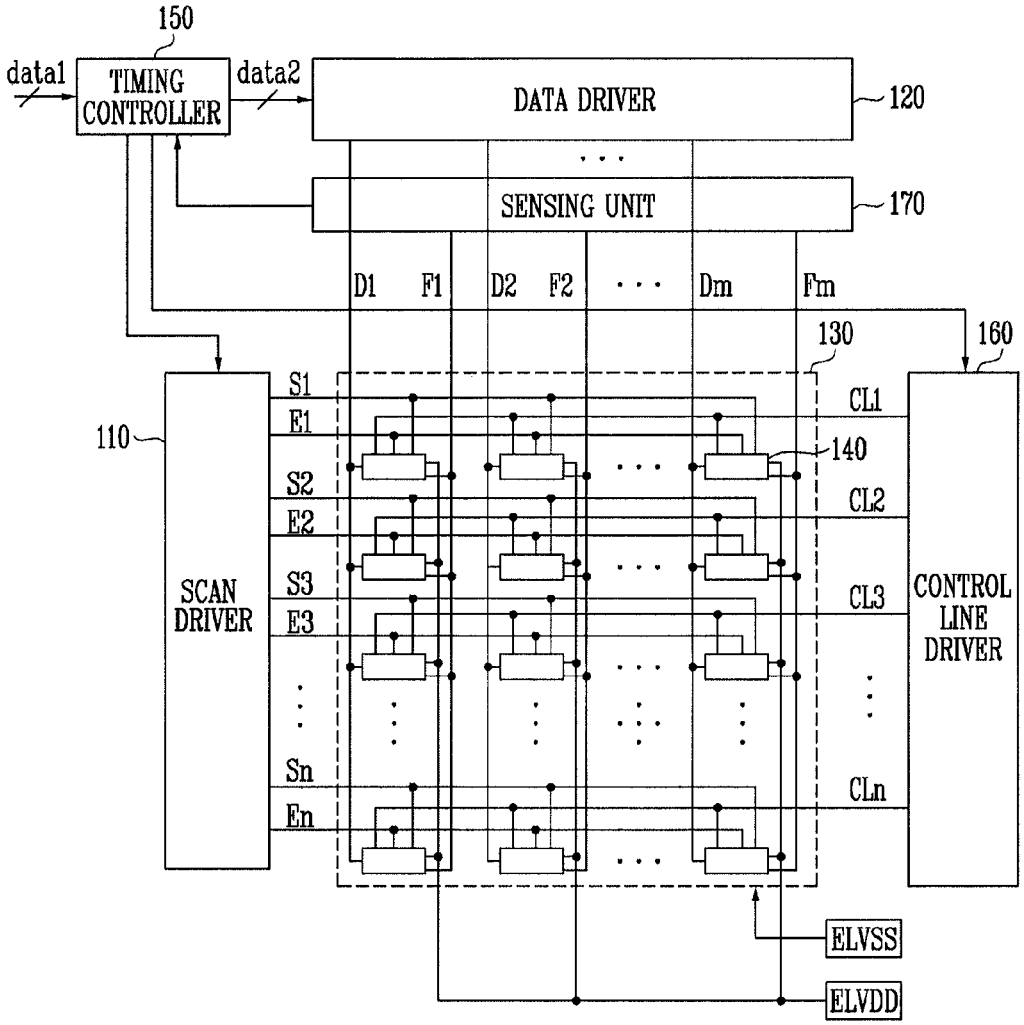
FIG. 2 is a view illustrating an organic light emitting display according to an embodiment.

FIG. 2 is a view illustrating an organic light emitting display according to an embodiment.

Referring to FIG. 2, the organic light emitting display includes a pixel unit 130 including pixels 140 positioned at the intersections of scan lines S1 to Sn and data lines D1 to Dm, a scan driver 110 for driving the scan lines S1 to Sn and emission control lines E1 to En, a data driver 120 for driving the data lines D1 to Dm, a control line driver 160 for driving control lines CL1 to CLn, and a timing controller 150 for controlling the scan driver 110, the data driver 120, and the timing controller 150.

The organic light emitting display further includes a sensing unit 170 for extracting deterioration information on organic light emitting diodes (OLED) provided in the pixels 140.

The pixel unit 130 includes the pixels 140 positioned at the intersections of the scan lines S1 to Sn, the emission control lines E1 to En, the data lines D1 to Dm, feedback lines F1 to Fm, and the control lines CL1 to CLn. The pixels 140 transmit the deterioration information to the feedback lines F1 to Fm in a sensing period and receive data signals corrected to correspond to the deterioration information in a driving period. The pixels 140 that receive the data signals generate light components with predetermined bright components while controlling the amount of current supplied from a first power supply ELVDD to a second power supply ELVSS via the OLEDs (not shown).

The scan driver 110 supplies scan signals to the scan lines S1 to Sn and supplies emission control lines to the emission control lines E1 to En. Supply waveforms of the scan signals and the emission control signals will be described later with reference to the drawings.

The control line driver 160 supplies control signals to the control lines CL1 to CLn in the sensing period. For example, the control line driver 160 may sequentially supply the control signals to the control lines CL1 to CLn in the sensing period. The deterioration information on the OLEDs provided in the pixels 140 is extracting in the sensing period. Here, threshold voltage information on a driving transistor may be further extracted in the sensing period to correspond to the structures of the pixels 140.

The data driver 120 receives second data data2 in the driving period and generates the data signals using the received second data data2. The data signals generated by the data driver 120 are supplied to the data lines D1 to Dm in synchronization with the scan signals.

The sensing unit 170 extracts the deterioration information on the OLEDs and supplies the extracted deterioration information to the timing controller 150 in the sensing period. That is, the sensing unit 170 extracts the deterioration information from the feedback lines F1 to Fm in the sensing period. The sensing unit 170 may be realized by currently published various types of circuits in order to compensate for deterioration from the outside. Further, the sensing unit 170 may extract the threshold voltages of driving transistors from the pixels 140.

The timing controller 150 controls the scan driver 110, the data driver 120, and the control line driver 160. In addition, the timing controller 150 changes first data data1 to correspond to the deterioration information supplied from the sensing unit to generate the second data data2. Here, the second data data2 is set so that the deterioration information on the OLEDs provided in the pixels 140 may be compensated for.

Figure 3:
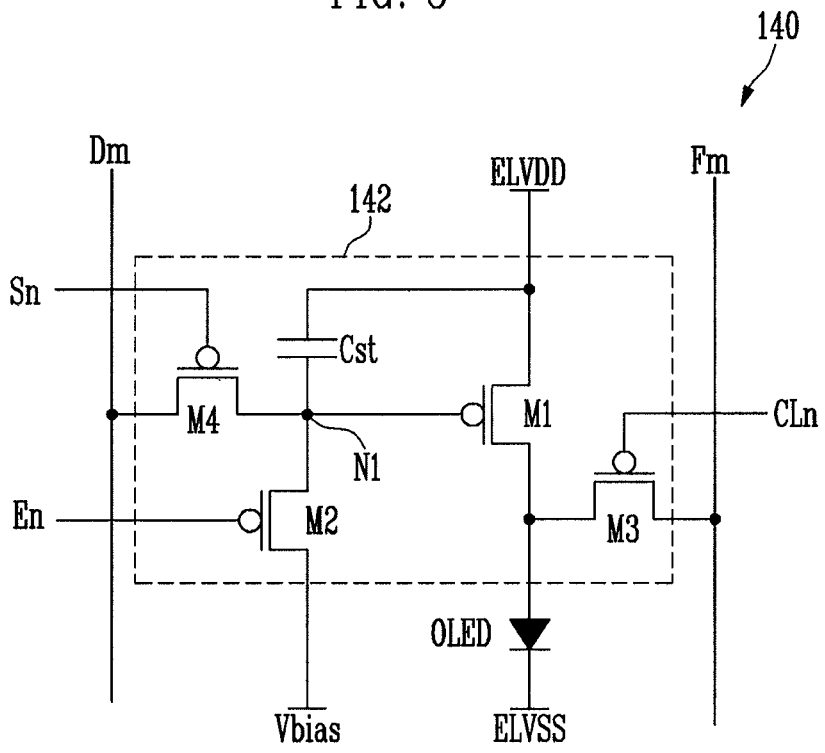
FIG. 3 is a view illustrating a pixel according to a first embodiment.

FIG. 3 is a view illustrating a pixel according to a first embodiment. In FIG. 3, for convenience sake, the pixel connected to the mth data line Dm and the nth scan line Sn will be illustrated.

Referring to FIG. 3, the pixel 140 according to the first embodiment includes an organic light emitting diode (OLED) and a pixel circuit 142 for supplying current to the OLED.

The anode electrode of the OLED is coupled to the pixel circuit 142 and the cathode electrode of the OLED is coupled to the second power supply ELVSS. The OLED generates light with predetermined brightness to correspond to current supplied from the pixel circuit 142.

The pixel circuit 142 supplies predetermined current to the OLED to correspond to a data signal. Therefore, the pixel circuit 142 includes first to fourth transistors M1 to M4 and a storage capacitor Cst.

The first electrode of the first transistor M1 is coupled to the first power supply ELVDD and the second electrode of the first transistor M1 is coupled to the anode electrode of the OLED. The first transistor M1 controls the amount of current supplied to the OLED to correspond to the voltage applied to the gate electrode thereof, that is, a first node N1.

The first electrode of the second transistor M2 is coupled to the first node N1 and the second electrode of the second transistor M2 is coupled to a bias power supply Vbias. The gate electrode of the second transistor M2 is coupled to the emission control line En. The second transistor M2 is turned off when the emission control signal is supplied to the emission control line En and is turned on when the emission control signal is not supplied. On the other hand, the bias power supply Vbias is set as a voltage at which the first transistor M1 may be turned off, that is, an off bias voltage. For example, the bias power supply Vbias is set as a higher voltage than the first power supply ELVDD.

The first electrode of the third transistor M3 is coupled to the anode electrode of the OLED and the second electrode of the third transistor M3 is coupled to the feedback line Fm. The gate electrode of the third transistor M3 is coupled to the control line LCn. The third transistor m3 is turned on when a control signal is supplied to the control line CLn to electrically couple the feedback line Fm to the anode electrode of the OLED.

The first electrode of the fourth transistor M4 is coupled to the data line Dm and the second electrode of the fourth transistor M4 is coupled to the first node N1. The gate electrode of the fourth transistor M4 is coupled to the scan line Sn. The fourth transistor M4 is turned on when the scan signal is supplied to the scan line Sn to electrically couple the data line Dm to the first node N1.

The storage capacitor Cst is coupled between the first power supply ELVDD and the first node N1. The storage capacitor Cst stores a voltage, corresponding to the data signal.

Figure 4A:
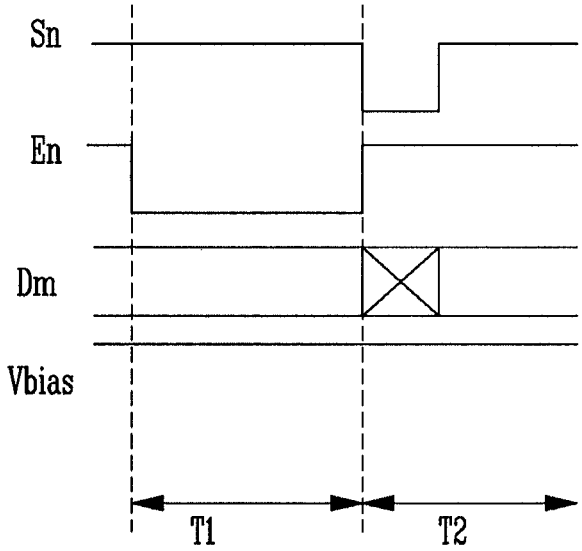
FIG. 4A is a view illustrating an embodiment of driving waveforms supplied to the pixel of FIG. 3 in a driving period.

FIG. 4A is a view illustrating an embodiment of driving waveforms supplied to the pixel of FIG. 3 in a driving period. Here, in the driving period, the pixel is normally driven.

Referring to FIG. 4A, first, in the first period T1, the emission control signal is not supplied to the emission control line En so that the second transistor M2 is turned on. When the second transistor M2 is turned on, the voltage of the bias power supply Vbias is supplied to the first node n1 so that the first transistor M1 is turned off. That is, in the first period t1, the first transistor M1 (that is, a driving transistor) receives an off bias voltage. In this case, the first transistor M1 is initialized by the off bias voltage. Therefore, the first transistor M1 may control the amount of current supplied to the OLED so that an image with desired brightness is displayed regardless of the data signal of a previous period.

Then, in a second period T2, the scan signal is supplied to the scan line Sn. In the second period t2, the emission control signal is supplied to the emission control line En. When the emission control signal is supplied to the emission control line En, the second transistor M2 is turned off. When the scan signal is supplied to the scan line Sn, the fourth transistor M4 is turned on. When the fourth transistor M4 is turned on, the data signal from the data line Dm is supplied to the first node N1. At this time, the storage capacitor Cst charges the voltage corresponding to the data signal. Then, the first transistor M1 supplies the current stored in the storage capacitor Cst to the OLED so that light with predetermined brightness is generated by the OLED.

In one embodiment, the pixels 140 repeat the above-described processes in the driving period to realize a predetermined image. Here, the above-described processes may be sequentially performed in units of horizontal lines.

Figure 4B:
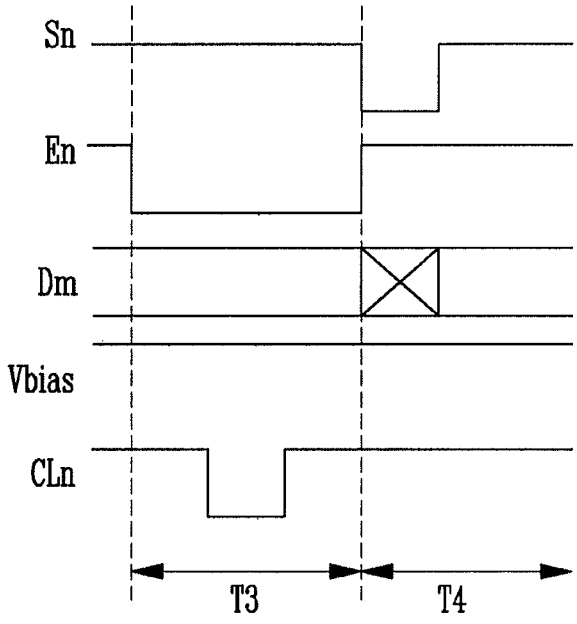
FIG. 4B is a view illustrating an embodiment of driving waveforms supplied to the pixel of FIG. 3 in a sensing period.

FIG. 4B is a view illustrating an embodiment of driving waveforms supplied to the pixel of FIG. 3 in a sensing period. Here, in the sensing period, the deterioration information on the OLED is extracted.

Referring to FIG. 4B, first, in a third period T3, the emission control signal is not supplied to the emission control line En so that the second transistor M2 is turned on. When the second transistor M2 is turned on, the voltage of the bias power supply Vbias is supplied to the first node N1 so that the first transistor M1 is turned off. That is, in the third period T3, the first transistor M1 receives the off bias voltage.

On the other hand, in the third period T3, the control signal is supplied to the control line CLn in at least partial period so that the third transistor M3 is turned on. When the third transistor M3 is turned on, the feedback line Fm is electrically coupled to the anode electrode of the OLED. In a period where the control signal is supplied to the control line CLn, predetermined current is supplied from the sensing unit 170 to the feedback line Fm. The predetermined current supplied to the feedback line Fm is supplied to the OLED so that a predetermined voltage is applied to the OLED. Here, a resistance value changes to correspond to the deterioration of the OLED. Therefore, the voltage applied to the OLED to correspond to the predetermined current includes the deterioration information on the OLED. The sensing unit 170 extracts the deterioration information using the predetermined voltage applied to the OLED and supplies the extracted deterioration information to the timing controller 150.

Then, in a fourth period T4, the scan signal is supplied to the scan line Sn. In the fourth period t4, the emission control signal is supplied to the emission control line En. When the emission control signal is supplied to the emission control line En, the second transistor M2 is turned off. When the scan signal is supplied to the scan line Sn, the fourth transistor M4 is turned on. When the fourth transistor M4 is turned on, the data signal from the data line Dm is supplied to the first node N1. At this time, the storage capacitor Cst charges the voltage corresponding to the data signal. Then, the first transistor M1 supplies the current corresponding to the voltage stored in the storage capacitor Cst to the OLED so that light with predetermined brightness is generated by the OLED.

In one embodiment, the pixels 140 repeat the above-described processes in the sensing period to realize a predetermined image. Here, the above-described processes may be sequentially performed in units of horizontal lines.

On the other hand, the driving period and the sensing period may be properly arranged in units of frames. For example, in most frames, the pixels are driven by the waveforms of the driving period and may be driven by the waveforms of the sensing period. Then, in a specific frame, the deterioration information is extracted from the OLED. Then, the timing controller 150 changes the first data data1 so that the deterioration of the OLEDs provided in the pixels 140 may be compensated for using the deterioration information to generate the second data data2. Therefore, in the driving period, an image with uniform brightness may be achieved by the pixels 140 regardless of the deterioration of the OLEDs.

Figure 5A:
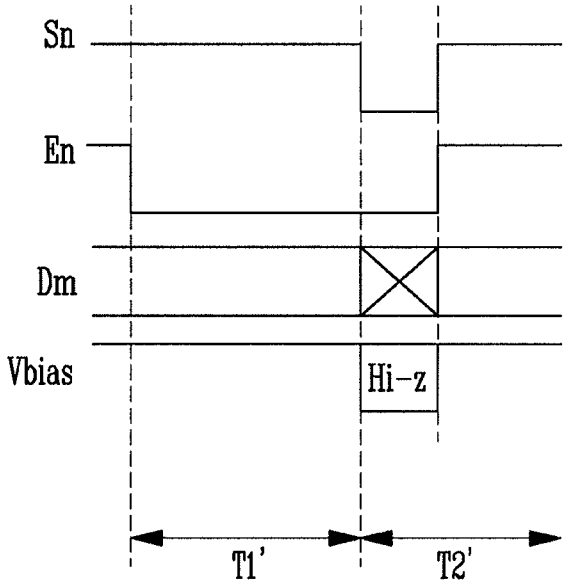
FIG. 5A is a view illustrating another embodiment of driving waveforms supplied to the pixel of FIG. 3 in the driving period.

FIG. 5A is a view illustrating another embodiment of driving waveforms supplied to the pixel of FIG. 3 in the driving period. In FIG. 5A, detailed description of the same elements as the elements of FIG. 4A will be omitted. A difference between FIGS. 4A and 4B and FIGS. 5A and 5B lies in that the emission control signals and the scan signals overlap each other in FIGS. 4A and 4B and that the emission control signals and the scan signals do not overlap each other.

Referring to FIG. 5A, first, in a first period T1', the second transistor M2 is turned on so that an off bias voltage is supplied to the first transistor M1.

Then, in a second period T2', the scan signal is supplied to the scan line Sn. Here, the emission control signal is not supplied to the emission control line En in a period where the scan signal is supplied to the scan line Sn. In this case, in the period where the scan signal is supplied to the scan line Sn, the second transistor M2 and the fourth transistor M4 are turned on.

When the fourth transistor M4 is turned on, the data signal from the data line Dm is supplied to the first node N1. At this time, the storage capacitor Cst charges the voltage corresponding to the data signal. On the other hand, in the period where the scan signal is supplied to the scan line Sn, the bias power supply Vbias is set in a high impedance Hi-z state. Therefore, in the period where the scan signal is supplied to the scan line Sn, although the second transistor M2 is turned on, the storage capacitor Cst may stably charge the voltage corresponding to the data signal.

After the voltage is stored in the storage capacitor Cst, supply of the scan signal to the scan line Sn is stopped so that the fourth transistor M4 is turned off and the emission control signal is supplied to the emission control line En so that the second transistor M2 is turned off. Then, the first transistor M1 supplies the current corresponding to the voltage stored in the storage capacitor Cst to the OLED so that light with predetermined brightness is generated by the OLED.

Figure 5B:
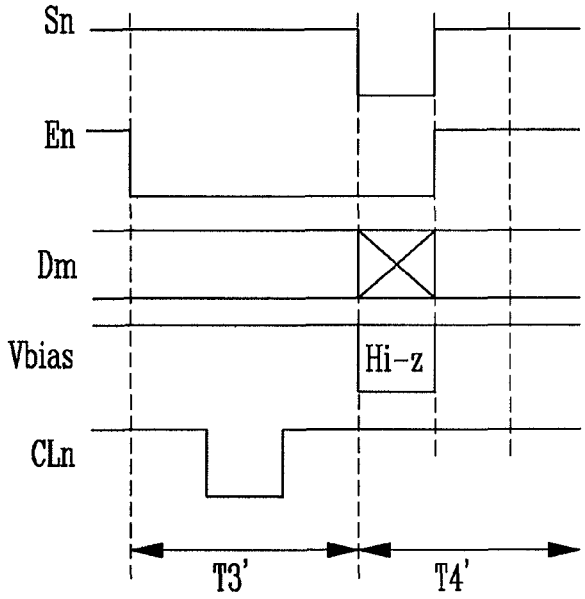
FIG. 5B is a view illustrating another embodiment of driving waveforms supplied to the pixel of FIG. 3 in the sensing period.

FIG. 5B is a view illustrating another embodiment of driving waveforms supplied to the pixel of FIG. 3 in the sensing period. In FIG. 5B, detailed description of the same elements as the elements of FIG. 4B will be omitted.

Referring to FIG. 5B, first, in a third period T3', the second transistor M2 is turned on so that an off bias voltage is supplied to the first transistor M1. In the third period T3', the third transistor M3 is turned on to correspond to the control signal supplied to the control line CLn. In the period where the third transistor M3 is turned on, the sensing unit 170 extracts the deterioration information on the OLED using the voltage applied to the OLED to correspond to predetermined current.

Then, in a fourth period T4', the scan signal is supplied to the scan line Sn. Here, the emission control signal is not supplied to the emission control line En in a period where the scan signal is supplied to the scan line Sn. In this case, in the period where the scan signal is supplied to the scan line Sn, the second transistor M2 and the fourth transistor M4 are turned on.

When the fourth transistor M4 is turned on, the data signal from the data line Dm is supplied to the first node N1. At this time, the storage capacitor Cst charges the voltage corresponding to the data signal. On the other hand, in the period where the scan signal is supplied to the scan line Sn, the bias power supply Vbias is set in a high impedance Hi-z state. Therefore, in the period where the scan signal is supplied to the scan line Sn, although the second transistor M2 is turned on, the storage capacitor Cst may stably charge the voltage corresponding to the data signal.

After the voltage is stored in the storage capacitor Cst, supply of the scan signal to the scan line Sn is stopped so that the fourth transistor M4 is turned off and the emission control signal is supplied to the emission control line En so that the second transistor M2 is turned off. Then, the first transistor M1 supplies the current corresponding to the voltage stored in the storage capacitor Cst to the OLED so that light with predetermined brightness is generated by the OLED.

Figure 6:
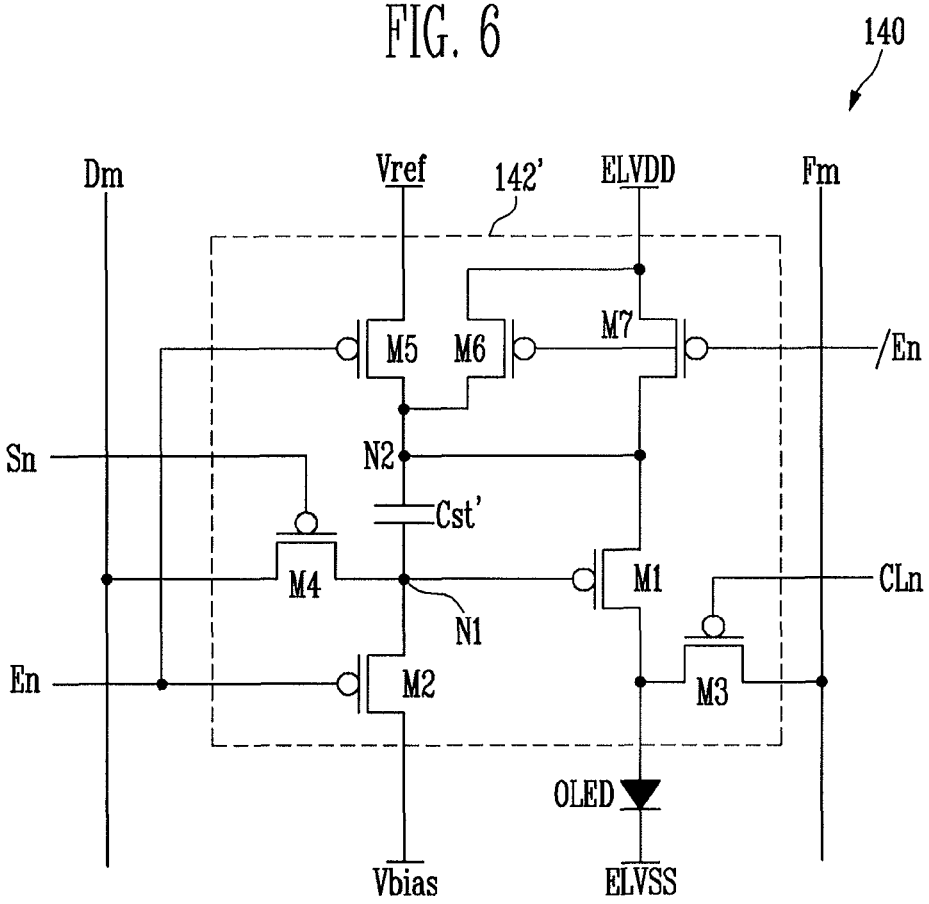
FIG. 6 is a view illustrating a pixel according to a second embodiment.

FIG. 6 is a view illustrating a pixel according to a second embodiment. In FIG. 6, for convenience sake, the pixel connected to the mth data line Dm and the nth scan line Sn will be illustrated. In FIG. 6, the same elements as the elements of FIG. 3 are denoted by the same reference numerals and detailed description thereof will be omitted.

Referring to FIG. 6, the pixel 140 according to the second embodiment includes an organic light emitting diode (OLED) and a pixel circuit 142' for supplying current to the OLED.

The anode electrode of the OLED is coupled to the pixel circuit 142' and the cathode electrode of the OLED is coupled to the second power supply ELVSS. The OLED generates light with predetermined brightness to correspond to current supplied from the pixel circuit 142'.

The pixel circuit 142' supplies predetermined current to the OLED to correspond to a data signal. Therefore, the pixel circuit 142' includes first to seventh transistors M1 to M7 and a storage capacitor Cst'.

The first terminal of the storage capacitor Cst' is coupled to the first node N1 and the second terminal of the storage capacitor Cst' is coupled to the second node N2. The storage capacitor Cst' charges a voltage corresponding to the data signal.

The first electrode of the fifth transistor M5 is coupled to a reference power supply Vref and the second electrode of the fifth transistor M5 is coupled to the second node N2. The gate electrode of the fifth transistor M5 is coupled to the emission control line En. The fifth transistor M5 is turned off when the emission control signal is supplied to the emission control line En and is turned on in the other cases.

The first electrode of the sixth transistor M6 is coupled to the first power supply ELVDD and the second electrode of the sixth transistor M6 is coupled to the second node N2. The gate electrode of the sixth transistor M6 is coupled to an inverted emission control line /En. The sixth transistor M6 is turned on when an inverted emission control signal is supplied to the inverted emission control line /En and is turned off in the other cases.

Figure 7A:
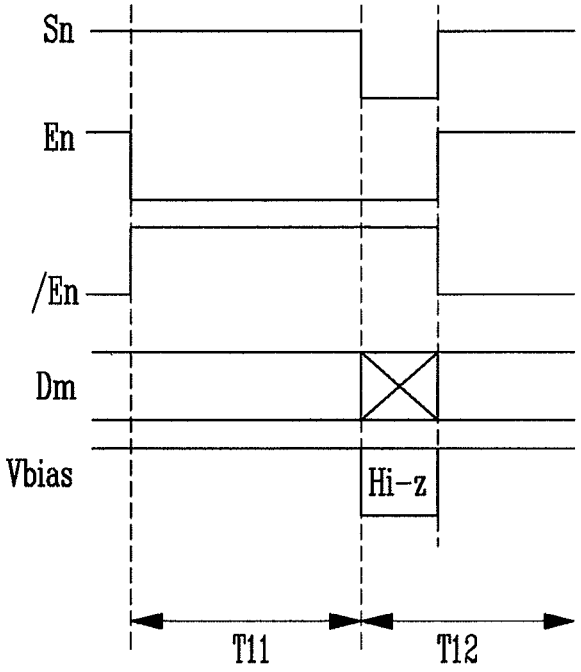
FIG. 7A is a view illustrating an embodiment of driving waveforms supplied to the pixel of FIG. 6 in the driving period.
Figure 7B:
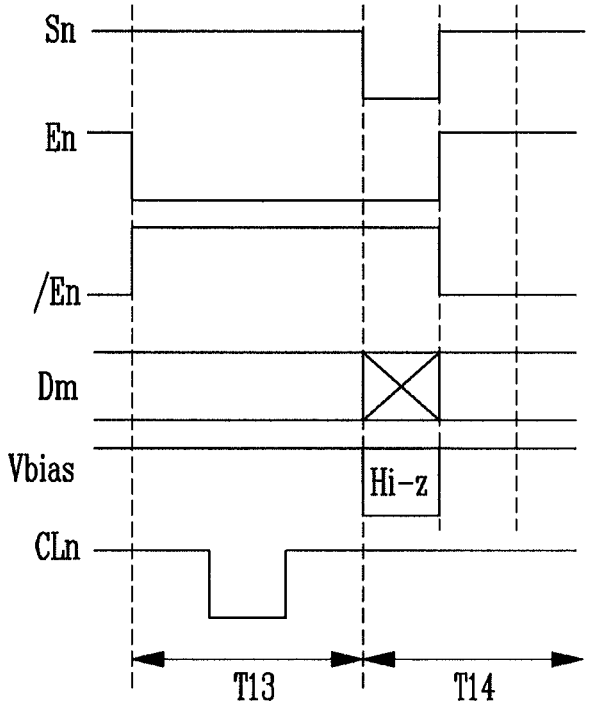
FIG. 7B is a view illustrating an embodiment of driving waveforms supplied to the pixel of FIG. 6 in the sensing period.
Figure 8:
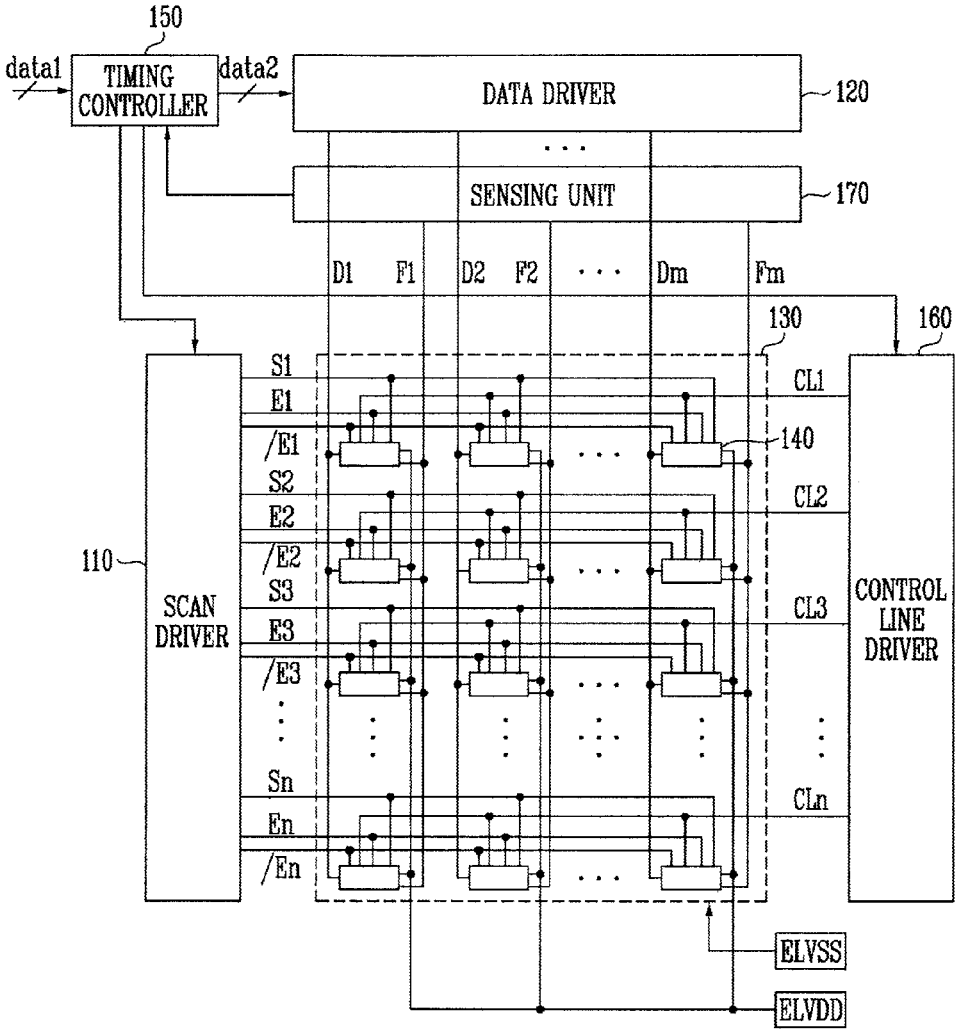
FIG. 8 is a view illustrating an organic light emitting display according to another embodiment.

Here, the inverted emission control signal is supplied to the inverted emission control line /En in the same period as the emission control signal supplied to the emission control line En and the polarity of the emission control signal is opposite to the polarity of the inverted emission control signal as illustrated in FIGS. 7A and 7B. That is, the emission control signal is set as a high voltage at which the transistors may be turned off and the inverted emission control signal is set as a low voltage at which the transistors may be turned on. For example, the inverted emission control signal supplied to an ith (i is a natural number) inverted emission control line Ei may be generated by inverting the emission control signal supplied to the ith emission control line Ei. Additionally, when the pixel of FIG. 6 is applied, inverted emission control lines /E1 to /En are additionally formed in every horizontal line like the emission control lines E1 to En as illustrated in FIG. 8.

The first electrode of the seventh transistor M7 is coupled to the first power supply ELVDD and the second electrode of the seventh transistor M7 is coupled to the first electrode of the first transistor M1. The gate electrode of the seventh transistor M7 is coupled to the inverted emission control line /En. The seventh transistor M7 is turned on when the inverted emission control signal is supplied to the inverted emission control line /En and is turned off in the other cases.

FIG. 7A is a view illustrating an embodiment of driving waveforms supplied to the pixel of FIG. 6 in the driving period.

Referring to FIG. 7A, first, in an eleventh period T11, the emission control signal is not supplied to the emission control line En and the inverted emission control signal is not supplied to the inverted emission control line/En. When the emission control signal is not supplied to the emission control line En, the second transistor M2 and the fifth transistor M5 are turned on. When the second transistor M2 is turned on, the voltage of the bias power supply Vbias is supplied to the first node N1. When the fifth transistor M5 is turned on, the voltage of the reference power supply Vref is supplied to the second node N2.

When the voltage of the bias power supply Vbias is supplied to the first node N1, in the eleventh period T11, the first transistor M1 receives an off bias voltage. In this case, the first transistor M1 is initialized by the off bias voltage.

Then, in a twelfth period T12, the scan signal is supplied to the scan line Sn. When the scan signal is supplied to the scan line Sn, the fourth transistor M4 is turned on. When the fourth transistor M4 is turned on, the data signal from the data line Dm is supplied to the first node N1. At this time, since the fifth transistor M5 is turned on, the storage capacitor Cst' charges a voltage corresponding to a difference between the reference power supply Vref and the data signal.

Here, the reference power supply Vref is not dropped to the voltage of the power supply at which current is not supplied to the pixels. Therefore, a desired voltage may be charged in the storage capacitor Cst' regardless of the voltage drop of the first power supply ELVDD. The voltage of the reference power supply Vref may have various values in comparison with the data signal. For example, the voltage of the reference power supply Vref may have the same value as the first power supply ELVDD.

In the period where the scan signal is supplied to the scan line Sn, the bias power supply Vbias is set in the high impedance state. In this case, a desired voltage may be charged in the storage capacitor Cst' regardless of whether the second transistor M2 is turned on.

After a predetermined voltage is charged in the storage capacitor Cst', the emission control signal is supplied to the emission control line En and the inverted emission control signal is supplied to the inverted emission control line /En. When the emission control signal is supplied to the emission control line En, the second transistor M2 and the fifth transistor M5 are turned off. When the inverted emission control signal is supplied to the inverted emission control line /En, the sixth transistor M6 and the seventh transistor M7 are turned on.

When the sixth transistor M6 is turned on, the second node N2 and the first power supply ELVDD are electrically coupled to each other. At this time, since the first node n1 is floated, the storage capacitor Cst' maintains a voltage charged in a previous period. When the seventh transistor M7 is turned on, the first transistor M1 and the first power supply ELVDD are electrically coupled to each other. At this time, the first transistor M1 controls the amount of current that flows from the first power supply ELVDD to the second power supply ELVSS via the OLED to correspond to the voltage applied to the first node N1.

In one embodiment, the pixels 140 repeat the above-described processes in the driving period to realize a predetermined image. Here, the above-describe processes may be sequentially performed in units of horizontal lines.

FIG. 7B is a view illustrating an embodiment of driving waveforms supplied to the pixel of FIG. 6 in the sensing period.

Referring to FIG. 7B first, in a thirteenth period T13, the emission control signal is not supplied to the emission control line En and the inverted emission control signal is not supplied to the inverted emission control line /E. When the emission control signal is not supplied to the emission control line En, the second transistor M2 and the fifth transistor M5 are turned on. When the second transistor M2 is turned on, the voltage of the bias power supply Vbias is supplied to the first node N1. When the fifth transistor M5 is turned on, the voltage of the reference power supply Vref is supplied to the second node N2.

When the voltage of the bias power supply Vbias is supplied to the first node N1, in the thirteenth period T13, the first transistor M1 receives an off bias voltage. In this case, the first transistor M1 is initialized by the off bias voltage.

On the other hand, in at least partial period of the thirteenth period T13, the control signal is supplied to the control line CLn so that the third transistor M3 is turned on. When the third transistor M3 is turned on, the feedback line Fm is electrically coupled to the anode electrode of the OLED. Then, a predetermined voltage is applied to the anode electrode of the OLED to correspond to predetermined current supplied from the sensing unit 170 and the sensing unit 170 extracts the deterioration information from the predetermined voltage applied to the OLED.

Then, in a fourteenth period T14, the scan signal is supplied to the scan line Sn. When the scan signal is supplied to the scan line Sn, the fourth transistor M4 is turned on. When the fourth transistor M4 is turned on, the data signal from the data line Dm is supplied to the first node N1. At this time, since the fifth transistor M5 is turned on, the storage capacitor Cst' charges the voltage corresponding to the difference between the reference power supply Vref and the data signal.

In the period where the scan signal is supplied to the scan line Sn, the bias power supply Vbias is set in the high impedance state. In this case, a desired voltage may be charged in the storage capacitor Cst' regardless of whether the second transistor M2 is turned on.

After the predetermined voltage is charged in the storage capacitor Cst', the emission control signal is supplied to the emission control line En and the inverted emission control signal is supplied to the inverted emission control line /En. When the emission control signal is supplied to the emission control line En, the second transistor M2 and the fifth transistor M5 are turned off. When the inverted emission control signal is supplied to the inverted emission control line /En, the sixth transistor M6 and the seventh transistor M7 are turned on.

When the sixth transistor M6 is turned on, the second node N2 and the first power supply ELVDD are electrically coupled to each other. At this time; since the first node n1 is floated, the storage capacitor Cst' maintains a voltage charged in a previous period. When the seventh transistor M7 is turned on, the first transistor M1 and the first power supply ELVDD are electrically coupled to each other. At this time, the first transistor M1 controls the amount of current that flows from the first power supply ELVDD to the second power supply ELVSS via the OLED to correspond to the voltage applied to the first node N1.

In one embodiment, the pixels 140 repeat the above-described processes in the driving period to realize a predetermined image. Here, the above-describe processes may be sequentially performed in units of horizontal lines.

According to at least one of the disclosed embodiments, the off bias voltage is applied to the driving transistor before the data signal is supplied to initialize the characteristic of the driving transistor. In this case, the driving transistor may supply desired current to the OLED regardless of the data signal of a previous period so that an image with uniform brightness is displayed. In addition, deterioration information on the OLED is extracted and data is changed in response to the extracted information so that an image with uniform brightness is displayed regardless of the deterioration of the OLED.

While the above embodiments have been described in connection with the accompanying drawings, it is to be understood that the present disclosure is not limited to the disclosed embodiments, but, on the contrary, is intended to cover various modifications and equivalent arrangements included within the spirit and scope of the appended claims, and equivalents thereof.

What is claimed is:

1. A pixel, comprising:

an organic light emitting diode (OLED);

a first transistor configured to control an amount of current that flows from a first power supply to a second power supply via the OLED in response to a voltage applied to a first node, wherein the first transistor is directly connected to the OLED;

a second transistor operatively coupled between a bias power supply and the first node, wherein the second transistor comprises a gate electrode coupled to an emission control line;

a third transistor operatively coupled between an anode electrode of the OLED and a feedback line, wherein the third transistor comprises a gate electrode coupled to a control line;

a fourth transistor operatively coupled between the first node and a data line, wherein the fourth transistor comprises a gate electrode coupled to a scan line;

a storage capacitor comprising a first terminal coupled to the first node and a second terminal coupled to the first power supply; and a fifth transistor operatively coupled between a reference power supply and the second terminal of the storage capacitor, wherein the fifth transistor comprises a gate electrode coupled to the emission control line.

2. The pixel as claimed in claim 1, wherein a voltage value of the bias power supply is configured to be set so that an off bias voltage is applied to the first transistor.

3. The pixel as claimed in claim 2, wherein the voltage of the bias power supply is higher than the first power supply.

4. The pixel as claimed in claim 1, wherein the second transistor is configured to be turned on before the fourth transistor is turned on.

5. The pixel as claimed in claim 4, wherein the second transistor is configured to be turned on after the fourth transistor is turned off.

6. The pixel as claimed in claim 4, wherein a turn on period of the second transistor at least partially overlaps with a turn on period of the fourth transistor.

7. The pixel as claimed in claim 6, wherein, when the turn on period of the second transistor overlaps with the turn on period of the fourth transistor, the bias power supply is configured to be set in a high impedance state.

8. The pixel as claimed in claim 1, wherein the third transistor is configured to be turned on in a partial period of a period in which the second transistor is turned on in a specific frame period of a plurality of frames.

9. A pixel, comprising:

an organic light emitting diode (OLED);

a first transistor configured to control an amount of current that flows from a first power supply to a second power supply via the OLED in response to a voltage applied to a first node;

a second transistor operatively coupled between a bias power supply and the first node, wherein the second transistor comprises a gate electrode coupled to an emission control line;

a third transistor operatively coupled between an anode electrode of the OLED and a feedback line, wherein the third transistor comprises a gate electrode coupled to a control line;

a fourth transistor operatively coupled between the first node and a data line, wherein the fourth transistor comprises a gate electrode coupled to a scan line;

a storage capacitor comprising a first terminal coupled to the first node and a second terminal coupled to the first power supply;

a fifth transistor operatively coupled between a reference power supply and the second terminal of the storage capacitor, wherein the fifth transistor comprises a gate electrode coupled to the emission control line;

a sixth transistor operatively coupled between the first power supply and the second terminal of the storage capacitor, wherein the sixth transistor comprises a gate electrode coupled to an inverted emission control line; and a seventh transistor operatively coupled between the first power supply and the first transistor, wherein the seventh transistor comprises a gate electrode coupled to the inverted emission control line.

10. The pixel as claimed in claim 9, wherein the sixth transistor and the second transistor are configured to be alternately turned on and off.

11. The pixel as claimed in claim 9, wherein the second transistor is configured to be turned on before the fourth transistor is turned on.

12. The pixel as claimed in claim 11, wherein the fourth transistor is configured to be turned on so that the turn on period of the fourth transistor at least partially overlaps with the turn on period of the second transistor.

13. The pixel as claimed in claim 12, wherein, when the turn on period of the second transistor overlaps with the turn on period of the fourth transistor, the bias power supply is configured to be set in a high impedance state.

14. The pixel as claimed in claim 9, wherein the third transistor is configured to be turned on in a partial period of a period in which the second transistor is turned on in a specific frame period of a plurality of frames.

15. An organic light emitting display, comprising:

a scan driver configured to drive a plurality of scan lines and a plurality of emission control lines;

a data driver configured to drive a plurality of data lines;

a control line driver configured to drive a plurality of control lines;

a sensing unit coupled to a plurality of feedback lines; and a plurality of pixels positioned at intersections of the scan lines and the data lines, wherein each of pixels positioned in an ith (i is a natural number) horizontal line comprises:

an organic light emitting diode (OLED);

a first transistor configured to control an amount of current that flows from a first power supply to a second power supply via the OLED in response to a voltage applied to a first node, wherein the first transistor is directly connected to the OLED;

a second transistor operatively coupled between a bias power supply and the first node, wherein the second transistor is configured to be turned off when an emission control signal is supplied to an ith emission control line, and turned on when the emission control signal is not supplied;

a third transistor operatively coupled between an anode electrode of the OLED and a jth (j is a natural number) feedback line, wherein the third transistor is configured to be turned on when a control signal is supplied to an ith control line;

a fourth transistor operatively coupled between the first node and a jth data line and configured to be turned on when a scan signal is supplied to an ith scan line;

a storage capacitor comprising a first terminal coupled to the first node and a second terminal coupled to the first power supply; and a fifth transistor operatively coupled between a reference power supply and the second terminal of the storage capacitor, wherein the fifth transistor is configured to be turned off when the emission control signal is supplied to the ith emission control line.

16. The organic light emitting display as claimed in claim 15, wherein a voltage value of the bias power supply is configured to be set so that an off bias voltage is applied to the first transistor.

17. The organic light emitting display as claimed in claim 16, wherein the voltage of the bias power supply is higher than a voltage of the first power supply.

18. The organic light emitting display as claimed in claim 16, wherein supply of an emission control signal to the ith emission control line is configured to discontinue before a scan signal is supplied to the ith scan line.

19. The organic light emitting display as claimed in claim 18, wherein the emission control signal supplied to the ith emission control line at least partially overlaps with the scan signal supplied to the ith scan line.

20. The organic light emitting display as claimed in claim 18, wherein the emission control signal supplied to the ith emission control line does not overlap with the scan signal supplied to the ith scan line.

21. The organic light emitting display as claimed in claim 20, wherein the bias power supply is configured to be set in a high impedance state when the scan signal is supplied to the ith scan line.

22. The organic light emitting display as claimed in claim 18, wherein a control signal is configured to be supplied to the ith control line not to overlap with the emission control signal supplied to the ith emission control line in a specific frame period of a plurality of frames.

23. The organic light emitting display as claimed in claim 15, further comprising a plurality of inverted emission control lines driven by the scan driver and formed to be coupled to the pixels in every horizontal line.

24. The organic light emitting display as claimed in claim 23, wherein an inverted emission control signal is configured to be supplied to an ith inverted emission control line in the same period as the emission control signal and has polarity inverted.

25. The organic light emitting display as claimed in claim 23, wherein each of the pixels positioned in the ith horizontal line further comprises:

a sixth transistor operatively coupled between the first power supply and the second terminal of the storage capacitor, wherein the sixth transistor is configured to be turned on when the inverted emission control signal is supplied to the ith inverted emission control line, and turned off in the other cases; and a seventh transistor operatively coupled between the first power supply and the first transistor, wherein the seventh transistor is configured to be turned on when the inverted emission control signal is supplied to the ith inverted emission control line, and turned off in the other cases.

* * * * *